US007983595B2

(12) United States Patent
Dickerson et al.

(10) Patent No.: US 7,983,595 B2
(45) Date of Patent: Jul. 19, 2011

(54) SEPARATOR HANGER FOR ENABLING CONSTRAINED POSITIONING OF A PACKAGING FABRIC INSERT IN AN IMAGE FORMING DEVICE

(75) Inventors: James Eric Dickerson, Lexington, KY (US); Alfred Louis Fahmy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 539 days.

(21) Appl. No.: 12/178,171

(22) Filed: Jul. 23, 2008

(65) Prior Publication Data

US 2010/0019113 A1 Jan. 28, 2010

(51) Int. Cl.

| | |
|---|---|
| ***G03G 15/00*** | (2006.01) |
| ***G03G 21/00*** | (2006.01) |
| ***G03G 15/08*** | (2006.01) |
| ***G03G 21/08*** | (2006.01) |

(52) U.S. Cl. ..... 399/110; 399/98; 399/103; 399/114

(58) Field of Classification Search ..... 399/91, 399/98, 99, 110, 111, 114, 119, 102, 103; 248/300; 206/461, 467

See application file for complete search history.

(56) References Cited

U.S. PATENT DOCUMENTS

| | | | | |
|---|---|---|---|---|
| 5,218,410 | A | 6/1993 | Nakabayashi et al. | |
| 5,227,844 | A | 7/1993 | Bhattacharjee et al. | |
| 5,749,026 | A * | 5/1998 | Goldie | 399/103 |
| 5,920,753 | A * | 7/1999 | Sasaki et al. | 399/111 |
| 5,946,520 | A * | 8/1999 | Hooper et al. | 399/102 X |
| 5,974,287 | A * | 10/1999 | Kurz et al. | 399/114 |
| 6,009,287 | A * | 12/1999 | Goldie | 399/103 |
| 6,101,348 | A * | 8/2000 | Nonaka et al. | 399/103 |
| 6,317,573 | B1 * | 11/2001 | Baker et al. | 399/114 |
| 6,681,089 | B2 * | 1/2004 | Dougherty | 399/111 |
| 6,845,225 | B2 | 1/2005 | Toyoda et al. | |
| 6,978,100 | B2 * | 12/2005 | Yasui et al. | 399/103 |
| 7,155,137 | B2 * | 12/2006 | Yasui et al. | 399/103 |
| 7,248,812 | B2 | 7/2007 | Tombs | |
| 2008/0038009 | A1 * | 2/2008 | Bracken et al. | 399/99 |

* cited by examiner

*Primary Examiner* — Sandra L Brase

(57) ABSTRACT

A separator hanger has a body with forward and rearward portions and a central portion interconnecting the forward and rearward portions. The rearward portion has side wing sections extending laterally in opposite directions beyond opposite side edges of the central portion with respective elements thereon adapted to extend through first slots in a packaging insert. The rearward portion also has a tail section between the side wing sections with an element thereon adapted to extend through a second slot in the packaging insert located between and offset from the first slots. Such elements provide the rearward portion in a threaded relationship with the packaging insert so as to detachably attach the rearward portion thereto. The forward portion is adapted to anchor the body to one portion of a device so as to thereby constrain the packaging insert to a position clear of another portion of the device located nearby the packaging insert.

20 Claims, 3 Drawing Sheets

SEPARATOR HANGER FOR ENABLING CONSTRAINED POSITIONING OF A PACKAGING FABRIC INSERT IN AN IMAGE FORMING DEVICE

CROSS REFERENCE TO RELATED APPLICATIONS

This patent application is related to the following copending U.S. patent application assigned to the assignee of the present invention: Ser. No. 11/461,819 filed Aug. 2, 2006, entitled "Device and Method for Removing Image Forming Substance Deposits". The disclosure of this application is hereby incorporated herein by reference.

BACKGROUND

1. Field of the Invention

The present invention relates generally to packaging of an image forming apparatus for handling and shipment and, more particularly, to a separator hanger for enabling constrained positioning of a packaging fabric insert in the image forming apparatus.

2. Description of the Related Art

A particular fabric insert has been found useful as a packaging material in preparing an image forming apparatus, such as an electrophotographic device or the like, for handling and shipment to an end-user. This insert is placed between a doctor blade and developer roll of the device to prevent handling and shipping problems due to toner fusing in the nip of these components. This insert and its method of use are disclosed in detail in the patent application cross-referenced above.

Although this packaging fabric insert has provided a satisfactory solution to the handling and shipping problems for which it was designed, several unintended and undesired side-effects have been noted. First, in its normal intended position of use, the insert may inadvertently touch a photoconductor drum of the device. The photoconductor (pc) drum is highly sensitive to its chemical environment and is easily damaged by foreign objects. It is unfortunate that a key step in the process for manufacturing the fabric material requires the use of silicone oil. Portions of the silicone oil retained in the insert after the manufacturing process may seep out later onto the surface of the photoconductor drum, crazing the drum surface and causing various defects on pages later printed by the drum. Second, the insert being in essence a packaging fabric material useful only during handling and shipping of the device naturally then requires removal by the end-user before a toner cartridge can be installed and used. If the insert is not removed, it may inadvertently fall into the end-user's printer and may cause damage.

Thus, there is still a need for an innovation that will overcome these additional problems without introducing any new unintended, undesirable side-effects.

SUMMARY OF THE INVENTION

The present invention meets this need by providing an innovation that will prevent the packaging fabric insert from touching the photoconductive drum as well as make the insert easy to remove and also make it readily apparent to the end-user that the insert needs to be removed in order to be able to install the toner cartridge. The innovation is a relatively simple separator hanger that provides an elegant solution to these problems and does not introduce any new unintended, undesirable side-effects in place thereof.

Accordingly, in an aspect of the present invention, a separator hanger includes a body having forward and rearward portions and a central portion extending between and interconnecting the forward and rearward portions, the central portion having opposite side edges extending between the forward and rearward portions. The rearward portion of the body includes a pair of side wing sections extending laterally in opposite directions with respect to one another and respectively beyond the opposite side edges of the central portion, the side wing sections having respective elements adapted to extend through respective first slots in a packaging insert. The rearward portion of the body also includes a tail section disposed between the side wing sections and having an element adapted to extend through a second slot in the packaging insert located between and offset from the first slots in the packaging insert such that the elements of the tail and side wing sections respectively provide the rearward portion of the body in a threaded relationship with the packaging insert so as to detachably attach the rearward portion of the body to the packaging insert. The forward portion of the body is adapted to anchor the body to one portion of a device so as to thereby constrain the packaging insert to a position clear of another portion of the device located nearby the packaging insert.

In another aspect of the present invention, the separator hanger includes a body having forward and rearward portions and a central portion extending between and interconnecting the forward and rearward portions, the central portion having opposite side edges extending between the forward and rearward portions. The rearward portion of the body includes sections extending laterally beyond the opposite side edges of the central portion and rearwardly from the central portion to adapt detachably attaching the rearward portion of the body to a packaging insert. The forward portion of the body is adapted to anchor the body to one portion of a device so as to thereby constrain the packaging insert to a position clear of another portion of the device located nearby the packaging insert. The forward portion of the body includes a head connected with the central portion of the body and having rear segments extend laterally in opposite directions with respect to the opposite side edges of the central portion of the body, and a pair of slits between the rear segments and the opposite side edges of the central portion and open solely at respective rear edges of the rear segments adjacent to the opposite side edges of the central portion to enable fitting of the one portion of the device through the slits and thereby anchoring of the head of the forward portion of the body to the one portion of the device.

BRIEF DESCRIPTION OF THE DRAWINGS

Figure 1:
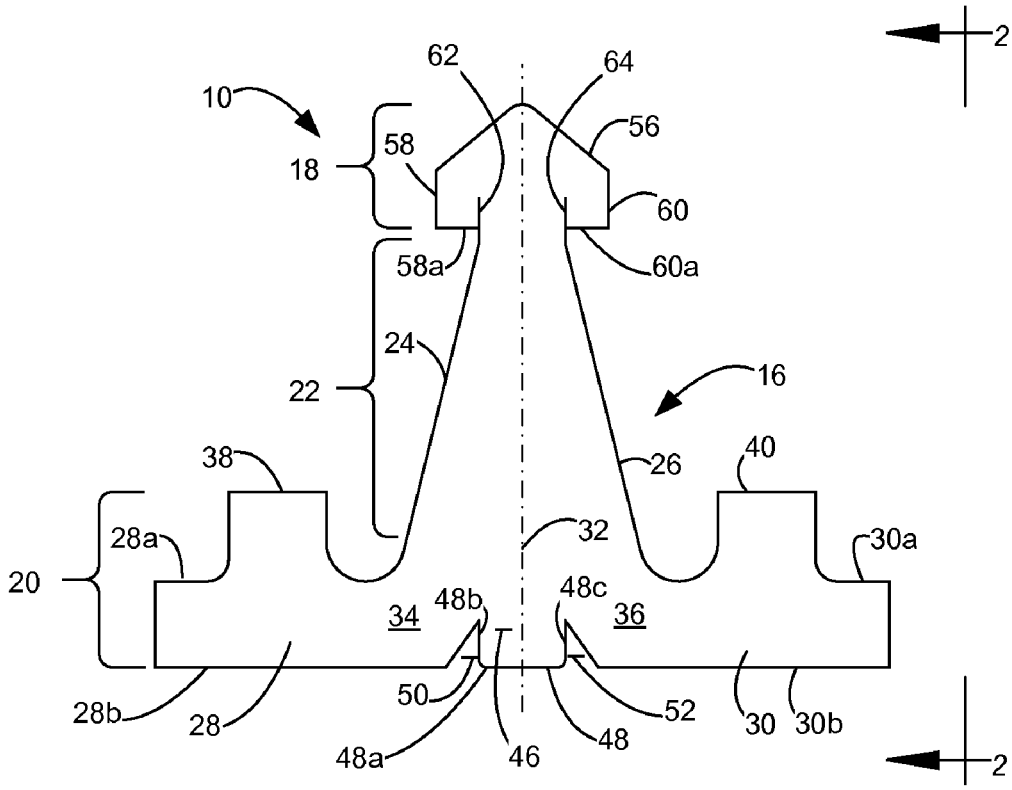
Figure 2:
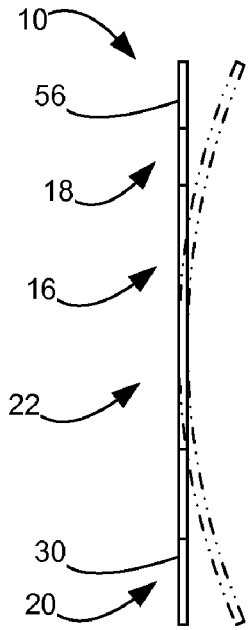
Figure 3:
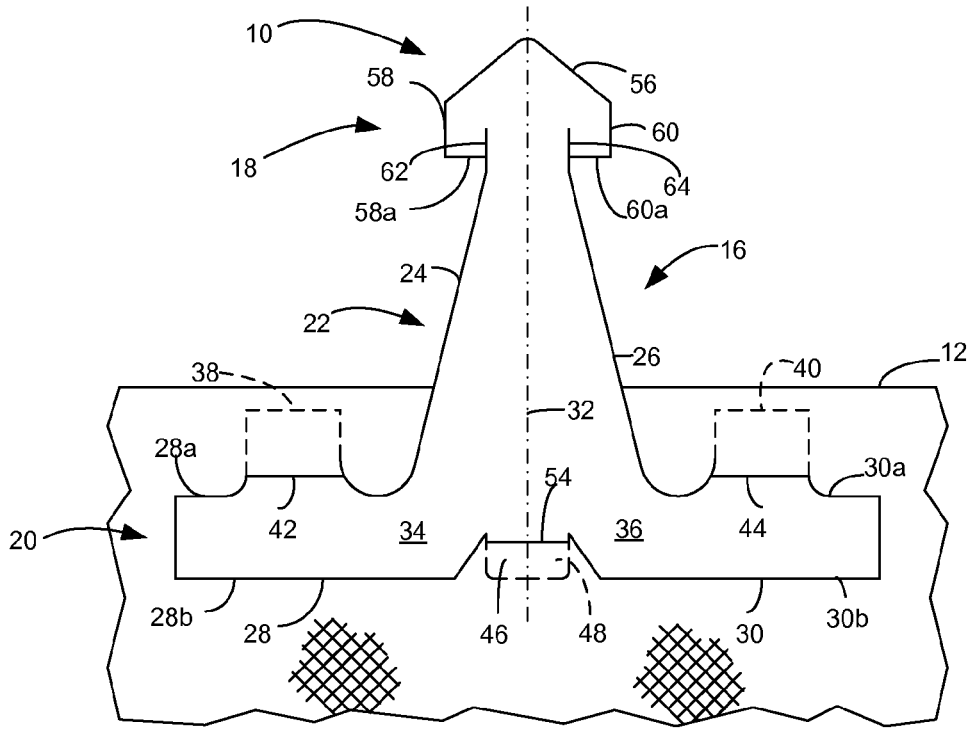
Figure 4:
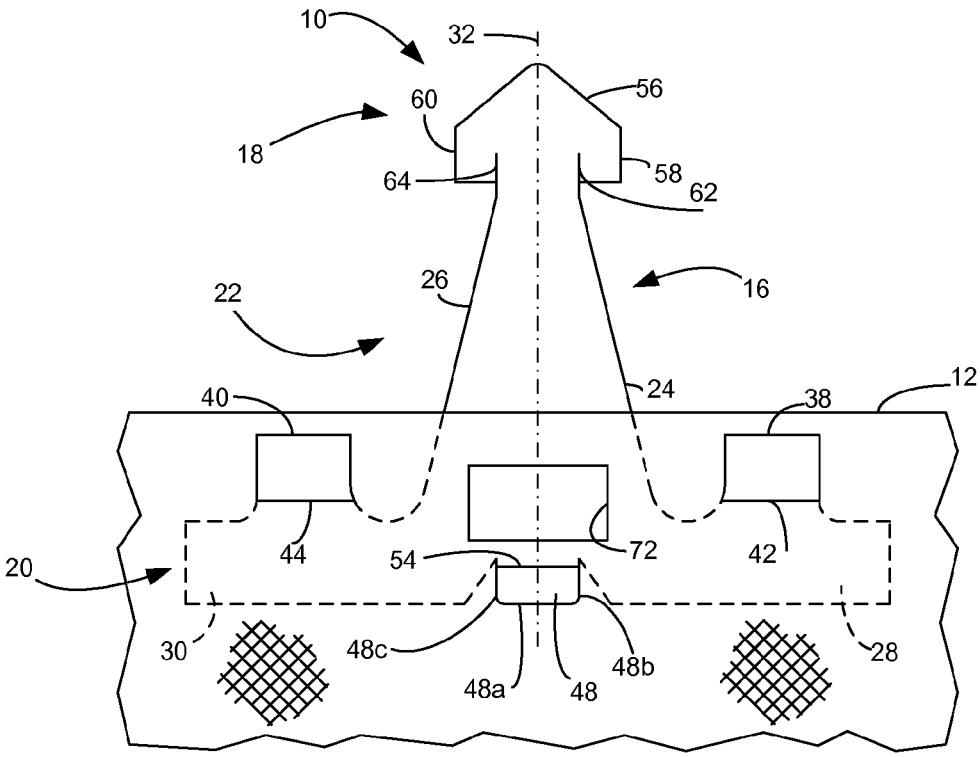
Figure 5:
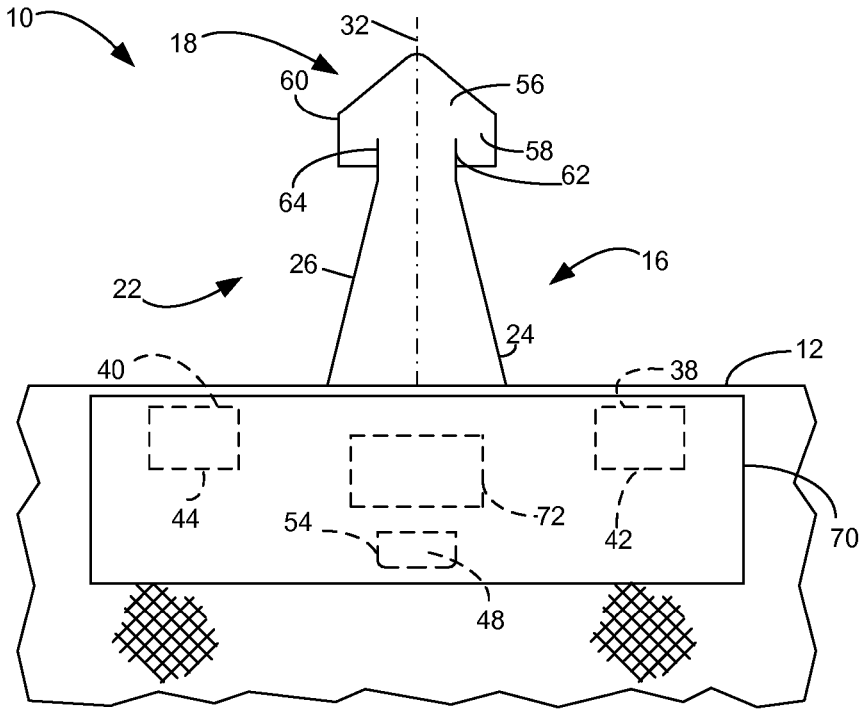
Figure 6:
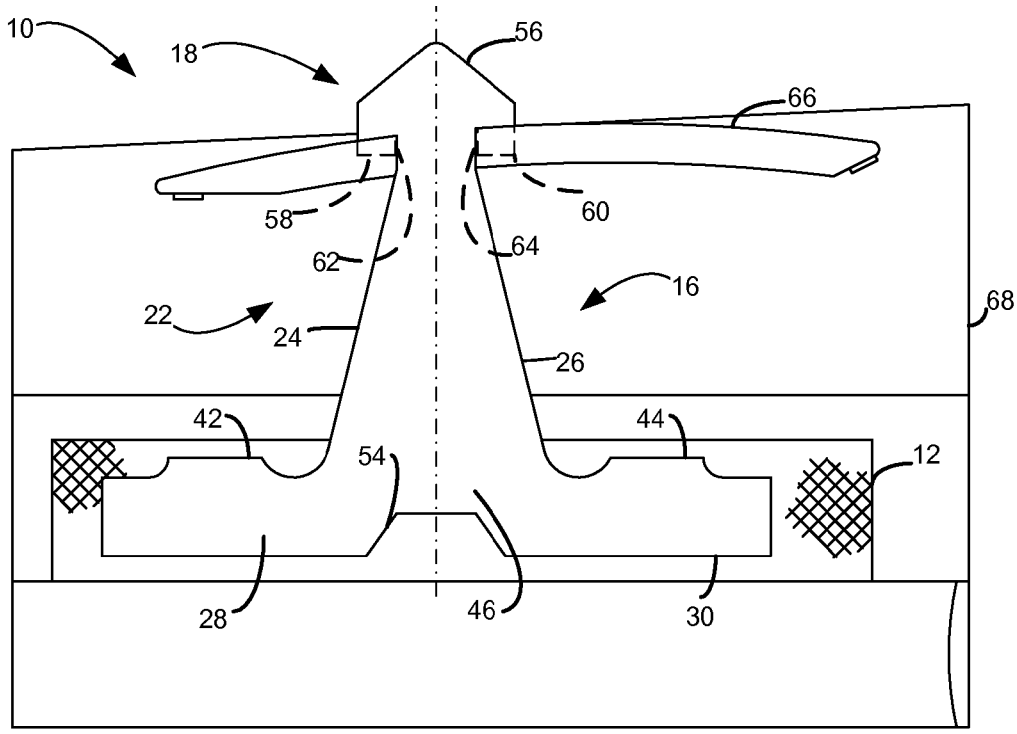

Having thus described the invention in general terms, reference will now be made to the accompanying drawings, which are not necessarily drawn to scale, and wherein:

FIG. 1 is a plan view of an exemplary embodiment of a separator hanger of the present invention;

FIG. 2 is a side view of the hanger as seen along line 2-2 of FIG. 1 also depicting the flexibility of the hanger;

FIG. 3 is a view similar to that of FIG. 1 but now showing the hanger in an assembled orientation with a packaging fabric insert;

FIG. 4 is a view similar to that of FIG. 3 but of a reverse side of the hanger in its assembled orientation with the insert;

FIG. 5 is a view similar to that of FIG. 4 but now showing an adhesive strip bonding the insert to the hanger; and FIG. 6 is a view similar to that of FIG. 3 but now showing the hanger of the present invention detachably anchored to a toner cartridge handle so as to prevent installation of the toner cartridge without first removing the insert and the hanger from an image forming apparatus.

DETAILED DESCRIPTION

The present invention now will be described more fully hereinafter with reference to the accompanying drawings, in which one or more, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views. Also, terms such as "forward", "rearward" and the like are terms of convenience and not to be construed as limiting terms.

Referring now to FIGS. 1-4, there is illustrated an exemplary embodiment of a separator hanger, generally designate 10, of the present invention for enabling constrained positioning of a packaging fabric insert 12 in and removal of the insert 12 from an electrophotographic image forming device 14 (see FIG. 6), or the like, before installation. The separator hanger 10 basically includes a body 16 having forward and rearward portions 18, 20 and a central portion 22 extending between and interconnecting the forward and rearward portions 18, 20. The central portion 22 has opposite side edges 24, 26 extending between the forward and rearward portion 18, 20. By way of example and not limitation, the body 16 may be generally flat such that the forward, rearward and central portions 18-22 share a common planar configuration. Also, the body 16, by way of example and not limitation, may be made of a suitably stiff but flexible, or semi-flexible, plastic material, such as polypropylene or the like, having a suitable thickness, such as, of approximately 1 mm.

More particularly, the rearward portion 20 of the body 16 includes a pair of side wing sections 28, 30. The side wing sections 28, 30 are mirror images of one another relative to a longitudinal axis 32 of the body 16. The side wing sections 28, 30 merge at regions 34, 36 of the body 16 from the central section 22 and extend laterally in opposite directions with respect to one another and beyond the respective opposite side edges 24, 26 of the central portion 22 in a generally transverse relationship to the longitudinal axis 32 of the body 16. The rearward portion 20 of the body 16 further including a pair of side tabs 38, 40. The side tabs 38, 40 are respectively connected to and extending forwardly from front edges 28*a*, 30*a* of the side wing sections 28, 30 and are spaced laterally from the opposite side edges 24, 26 of the central portion 22 of the body 16 to enable insertion of the side tabs 38, 40 through respective slots 42, 44 in the packaging insert 12, as seen in FIGS. 3 and 4.

The rearward portion 20 of the body 16 also includes a tail section 46 disposed between the side wing sections 28, 30. The tail section 46 includes a central tab 48 and a pair of notches 50, 52 defined in the rearward portion 20. The center tab 48 terminates in a rear edge 48*a* that is generally aligned with rear edges 28*b*, 30*b* on the side wing sections 28, 30. The notches 50, 52 are located at or adjacent to opposite lateral sides 48*b*, 48*c* of the center tab 48 so as to separate the center tab 48 from the side wing sections 28, 30 to enable insertion of the center tab 48 through another slot 54 in the packaging fabric insert 12. With the side tabs 38, 40 and the center tab 48 respectively inserted through the slots 42, 44 and 54 the rearward portion 20 of the body 16 is provided in a threaded or interlaced relationship with the packaging fabric insert 12 so as to detachably attach the rearward portion 20 to the insert 12.

The forward portion 18 of the body 16 includes a head 56 connected with the central portion 22 of the body 16 and rear segments 58, 60 thereof connected with and extend laterally in opposite directions with respect to one another from the opposite side edges 24, 26 of the central portion 22 of the body 16. Also, a pair of slits 62, 64 are formed in the rear segments 58, 60 of the head 56 so as to open at respective rear edges 58*a*, 60*a* of the rear segments 58, 60 adjacent to the opposite side edges 24, 26 of the central portion 22 of the body 16. The slits 62, 64 enable fitting one portion, such as a handle 66, of the toner cartridge 68 of the device 14 through the slits 62, 64 and thereby anchoring the head 56 of the forward portion 18 of the body 16 to the handle 66 so as to thereby constraint the fabric insert 12 to a position clear of another portion, such as the photoconductor drum (not shown) located nearby the cartridge 68.

Thus, the rearward portion 20 of the body 16 includes multiple sections 28, 30 and 40 extending laterally beyond the opposite side edges 24, 26 of the central portion 22 and rearwardly from the central portion 22 which are configured with side and center tabs 38, 40 and 48 to detachably attach the rearward portion 20 of the body 16 to the packaging insert 12 by threading or interlacing the tabs 38, 40, 48 with the slots 42, 44, 54 in the packaging insert 12. The forward portion 18 of the body 16 is configured to anchor or hook the body 16 to one portion of the device 14 so as to thereby constrain the packaging insert 12 to a position clear of another portion of the device 14 located nearby the packaging insert 12. The hanger 10 holds the packaging insert 12 taut and away from the photoconductor drum, while providing easy and ready access to the end-user for removal.

The opposite side edges 24, 26 of the central portion 22 of the body 16 converge toward one another going from the rearward portion 20 to the forward portion 18 thereof so as to provide the central portion 22 with a tapered configuration. The head 56 on the forward portion 18 of the body 16 has an arrowhead configuration which together with the tapered configuration of the central portion 22 of the body 16 indicate to an end-user the direction in which the hanger 10 should be pulled for removal prior to installation. Also, an adhesive strip 70, as seen in FIG. 5, can be applied across the exposed side tabs 38, 40 and center tab 48 of the rearward portion 20 of the body 18 when they are in the threaded relationship with the packaging insert 12 so as to reinforce or further secure the detachable attachment of the rearward portion 20 of the body 16 to the packaging insert 12. Also, a window 72 can be cut into the fabric insert 12 above the center slot 54 to allow exposure of additional surface area of the hanger 10 to which the adhesive strip 70 can adhere.

As seen in FIG. 6, the separator hanger 10 in hooking onto the handle 66 of the toner cartridge 68 constitutes a mechanical lock-out feature which will not allow installation of the cartridge 68 into the device 14 unless the packaging fabric insert 12 is removed. The separator hanger 10 blocks the path of the cartridge 68 into the device 14 so that even if the end-user neglects to remove the insert 12, the cartridge 68 cannot be installed with the insert 12 thereon. A fool-proof way is thus provided to prevent the toner cartridge 68 from being used while the insert 12 is still installed.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A separator hanger, comprising:

a body having forward and rearward portions and a central portion extending between and interconnecting said forward and rearward portions, said central portion having opposite side edges extending between said forward and rearward portions;

wherein said rearward portion of said body includes:

a pair of side wing sections extending laterally in opposite directions with respect to one another and respectively beyond said opposite side edges of said central portion, said side wing sections having respective elements adapted to extend through respective first slots in a packaging insert, and a tail section disposed between said side wing sections and having an element adapted to extend through a second slot in the packaging insert located between and offset from the first slots in the packaging insert such that said elements of said tail and side wing sections respectively provide said rearward portion of said body in a threaded relationship with the packaging insert so as to detachably attach said rearward portion of said body to the packaging insert; and wherein said forward portion of said body is adapted to anchor said body to one portion of a device so as to thereby constrain the packaging insert to a position clear of another portion of the device located nearby the packaging insert.

2. The hanger of claim 1 wherein said forward, rearward and central portions of said body substantially occupy a common plane.

3. The hanger of claim 1 wherein said body is made of a flexible plastic material.

4. The hanger of claim 1 wherein said element of said tail section is a rearward extending center tab located on said rearward portion of said body and adapted to insert through the second slot in the packaging insert.

5. The hanger of claim 4 wherein said rearward portion of said body also includes a pair of notches defined respectively adjacent to opposite lateral sides of said center tab so as to separate said center tab of said tail section from said side wing sections to enable insertion of said center tab through the second slot in the packaging insert.

6. The hanger of claim 4 wherein said elements of said side wing sections are side tabs connected to and extending forward from front edges of said side wing sections and spaced laterally from said opposite side edges of said central portion to enable insertion of said side tabs through the respective first slots in the packaging insert such that said side tabs and said center tab respectively provide said rearward portion of said body in the threaded relationship with the packaging insert so as to detachably attach said rearward portion of said body to the packaging insert.

7. The hanger of claim 6 further comprising:

an adhesive strip adapted to be applied across said side tabs and center tab of said rearward portion of said body when said rearward portion in the threaded relationship with the packaging insert so as to reinforce the detachable attachment of said rearward portion of said body to the packaging insert.

8. The hanger of claim 1 wherein said forward portion of said body includes a head connected with said central portion of said body and having rear segments extend laterally in opposite directions with respect to said opposite side edges of said central portion of said body, said forward portion also having a pair of slits between said rear segments and said opposite side edges of said central portion and open solely at respective rear edges of said rear segments adjacent to said opposite side edges of said central portion to enable fitting of the one portion of the device through said slits and thereby anchoring of said head of said forward portion of said body to the one portion of the device.

9. A separator hanger, comprising:

a body having forward and rearward portions and a central portion extending between and interconnecting said forward and rearward portions, said central portion having opposite side edges extending between said forward and rearward;

wherein said rearward portion of said body includes sections extending laterally beyond said opposite side edges of said central portion and rearwardly from said central portion to adapt detachably attaching said rearward portion of said body to a packaging insert; and wherein said forward portion of said body is adapted to anchor said body to one portion of a device so as to thereby constrain the packaging insert to a position clear of another portion of the device located nearby the packaging insert, said forward portion of said body including a head connected with said central portion of said body and having rear segments extend laterally in opposite directions with respect to said opposite side edges of said central portion of said body, said forward portion also having a pair of slits between said rear segments and said opposite side edges of said central portion and open solely at respective rear edges of said rear segments adjacent to said opposite side edges of said central portion to enable fitting of the one portion of the device through said slits and thereby anchoring of said head of said forward portion of said body to the one portion of the device so as to thereby constrain the packaging insert to the position clear of the another portion of the device located nearby the packaging insert.

10. The hanger of claim 9 wherein said opposite side edges of said central portion converge toward one another going from said rearward portion thereof to said forward portion thereof so as to provide said central portion with a tapered configuration.

11. The hanger of claim 10 wherein said head on said forward portion of said body has an arrowhead configuration which together with said tapered configuration of said central portion of said body indicate to an end-user the direction in which said hanger should be pulled for removal prior to installation.

12. The hanger of claim 9 wherein said rearward portion of said body includes a pair of side wing sections extending laterally in opposite directions with respect to one another and respectively beyond said opposite side edges of said central portion, said side wing sections having respective elements adapted to engage the packaging insert.

13. The hanger of claim 12 wherein said rearward portion of said body also includes a tail section disposed between said side wing sections and having an element adapted to engage the packaging insert such that said elements of said tail and side wing sections respectively adapt said rearward portion of said body to detachably attach to the packaging insert.

14. The hanger of claim 13 wherein said element of said tail section is a rearward extending center tab located on said rearward portion of said body and adapted to insert through a slot in the packaging insert.

15. The hanger of claim 14 wherein said rearward portion of said body also includes a pair of notches defined respectively adjacent to opposite lateral sides of said center tab so as to separate said center tab of said tail section from said side wing sections to enable insertion of said center tab through the slot in the packaging insert.

16. The hanger of claim 14 wherein said elements of said side wing sections are side tabs connected to and extending forward from front edges of said side wing sections and spaced laterally from said opposite side edges of said central portion to enable insertion of said side tabs through respective slots in the packaging insert such that said side tabs and said center tab respectively provide said rearward portion of said body in a threaded relationship with the packaging insert so as to detachably attach said rearward portion of said body to the packaging insert.

17. A separator hanger, comprising:

a body made of flexible material and having forward and rearward portions and a central portion extending between and interconnecting said forward and rearward portions, said central portion having opposite side edges extending between said rearward and forward portions;

wherein said rearward portion of said body includes a pair of side wing sections extending laterally in opposite directions with respect to one another and beyond said respective opposite side edges of said central portion;

wherein said rearward portion of said body also includes a central tab and a pair of notches defined in said rearward portion, each of said notches located adjacent to one of a pair of opposite lateral sides of said center tab so as to separate said center tab from said side wing sections to enable insertion of said center tab through one slot in a packaging insert;

wherein said rearward portion of said body further includes a pair of side tabs each connected to and extending forwardly from a front edge of one of said side wing sections and spaced laterally from said opposite side edges of said central portion of said body to enable insertion of said side tabs through respective other slots in the packaging insert such that said side tabs and said center tab respectively provide said rearward portion of said body in a threaded relationship with the packaging insert so as to detachably attach said rearward portion of said body to the packaging insert; and wherein said forward portion of said body includes a head connected with said central portion of said body and rear segments connected with and extend laterally in opposite directions with respect to one another from said opposite side edges of said central portion of said body, and a pair of slits formed in said rear segments of said head so as to open at respective rear edges of said rear segments adjacent to said side edges of said central portion of said body to enable fitting of one portion of a device through said slits and thereby anchoring of said head of said forward portion of said body to the one portion of the device so as to thereby constrain the packaging insert to a position clear of another portion of the device located nearby the packaging insert.

18. The hanger of claim 17 wherein said center tab terminates in a rear edge that is generally aligned with rear edges on said side wing sections.

19. The hanger of claim 17 wherein said opposite side edges of said central portion converge toward one another going from said rearward portion thereof to said forward portion thereof so as to provide said central portion with a tapered configuration.

20. The hanger of claim 19 wherein said head on said forward portion of said body has an arrowhead configuration which together with said tapered configuration of said central portion of said body indicate to an end-user the direction in which said hanger should be pulled for removal prior to installation.

* * * * *